US006793527B2

(12) United States Patent
Noro

(10) Patent No.: US 6,793,527 B2
(45) Date of Patent: Sep. 21, 2004

(54) CONNECTOR

(75) Inventor: Yutaka Noro, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/163,747

(22) Filed: Jun. 4, 2002

(65) Prior Publication Data

US 2002/0192998 A1 Dec. 19, 2002

(30) Foreign Application Priority Data

Jun. 14, 2001 (JP) ..... 2001-180392
Jun. 14, 2001 (JP) ..... 2001-180393

(51) Int. Cl.[7] ..... H01R 9/05
(52) U.S. Cl. ..... 439/579; 439/497; 439/607
(58) Field of Search ..... 439/492, 495, 439/497, 607, 610, 578, 579, 596

(56) References Cited

U.S. PATENT DOCUMENTS

| | | | | | |
|---|---|---|---|---|---|
| 4,619,487 | A | | 10/1986 | Brush, Jr. | 439/497 |
| 4,772,212 | A | | 9/1988 | Sotolongo | 439/98 |
| 5,188,541 | A | * | 2/1993 | Comerci et al. | 439/596 |
| 5,545,052 | A | * | 8/1996 | Hirai | 439/354 |
| 5,605,469 | A | | 2/1997 | Wellinsky et al. | 439/607 |
| 5,696,669 | A | * | 12/1997 | Bassler et al. | 361/816 |
| 5,759,065 | A | * | 6/1998 | Hatagishi et al. | 439/596 |
| 5,980,308 | A | | 11/1999 | Hu et al. | 439/497 |
| 6,007,385 | A | | 12/1999 | Wu | 439/610 |
| 6,162,086 | A | | 12/2000 | Kuo | 439/497 |
| 6,217,378 | B1 | * | 4/2001 | Wu | 439/567 |
| 6,224,416 | B1 | | 5/2001 | Nagai | 439/400 |
| 6,273,753 | B1 | * | 8/2001 | Ko | 439/579 |
| 6,338,652 | B1 | * | 1/2002 | Ko | 439/579 |
| 6,358,089 | B1 | * | 3/2002 | Kuroda et al. | 439/607 |
| 6,364,702 | B1 | | 4/2002 | Mochizuki et al. | 439/579 |
| 6,419,524 | B1 | * | 7/2002 | Ma | 439/607 |

* cited by examiner

*Primary Examiner*—Hien Vu
(74) *Attorney, Agent, or Firm*—Anthony J. Casella; Gerald E. Hespos

(57) ABSTRACT

A shield shell (40) has a base (41) and a lid (42) formed together through a pair of coupling pieces (47). A housing (20) on which terminal members (21) are mounted is put on the base (41), and distal ends of shielded electric wires (11) are mounted on the housing (20). A core (12) in each shielded electric wire (11) is brought into insulation displacement in the terminal member (21), and a cover (35) closes the housing (20). The lid (42) is bent at the coupling pieces (47). Thus, the housing (20) is disposed and locked between the base (41) and the lid (42). Contact pieces (56) on the lid (42) of the shield shell (40) pass through windows (38) in the cover (38) and elastically contact a short circuit member (18).

9 Claims, 16 Drawing Sheets

CONNECTOR

BACKGROUND OF THE INVENTION

1. Field of the Invention

This invention relates to a connector to be connected to a distal end of a flat cable having a plurality of juxtaposed shielded electric wires or to the distal ends of a substantially planar array of juxtaposed separate shielded electric wires.

2. Description of the Related Art

A known connector for a flat cable is shown in U.S. Pat. No. 6,364,702 and includes a housing for mounting terminals that are connected to cores of shielded electric wires in the flat cable. The known connector also includes a shield shell having a base shell adapted to be mounted on a lower surface of the housing and a lid shell adapted to cover an upper surface of the housing. The known connector is assembled by first mounting the base shell to the housing. A distal end of the flat cable then is mounted on the housing, and in turn the lid shell is put on the base shell. Thus, the core of each shielded electric wire is connected to the corresponding terminal and a shielding layer of each shielded electric wire is disposed between the base shell and the lid shell to obtain a shielding effect, such as elimination of radiation noises.

The base shell and lid shell in the above-described known connector are formed separately and the lid shell is attached to the base shell after forming. Consequently, it is necessary to package the shells individually for transport and to undertake inventory management of the separate parts for storage. This involves troublesome handling. Also, it is difficult to locate the shells in a correct position for assembly. This results in inefficient assembling work.

Another connector for a flat cable is disclosed in U.S. Pat. No. 6,224,416. This known connector for a flat cable includes a housing for mounting terminals in juxtaposed positions. The terminals are connected to cores of shielded electric wires in the flat cable in an insulation displacement manner. A cover is mounted on the housing to maintain an insulation displacement condition by pushing the shielded electric wires and a shield shell mounted on the housing to enclose the housing and to be connected to shielding layers of the shielded wires.

The cover for pushing the shielded electric wires in this second known connector is formed separately from the housing and is attached to the housing later on. Consequently, it is necessary to package the cover and housing individually for transport and to undertake inventory management of parts for storage. This involves troublesome handling. Also, it is difficult to locate the cover in a correct position during assembly. This results in inefficient assembling work.

Accordingly, in view of the above problems, an object of the present invention is to provide a connector for a flat cable that is convenient for handling and excellent at an assembling work.

SUMMARY OF THE INVENTION

The invention is directed to a connector for connection to a distal end of a flat cable having a plurality of juxtaposed shielded electric wires or to the distal ends of a substantially planar array of juxtaposed separate shielded electric wires. Terminals are connected to cores of shielded electric wires in a housing, and a shield shell covers the housing to connect with shielding layers of the shielded electric wires. The connector is characterized in that the shield shell comprises a base adapted to mount the housing and a lid formed integrally with the base so that the lid can be moved to an open position and a closing position with respect to the base.

The base and lid are formed integrally from a sheet of plate material, and are joined through foldable coupling pieces.

The coupling pieces may be provided on the opposite ends of a fold line with notches, and a bead for reinforcement is formed on each coupling piece at either upper or lower sides with respect to the fold line.

Escape recesses may be formed on surfaces of the housing that oppose the folded portions of the coupling pieces so that the coupling pieces can be folded over a predetermined foldable angle.

The invention also may comprise a cover that is rotatably coupled to the housing to maintain a contact condition between the shielded electric wires and the terminals by pushing the shielded electric wires.

The lid of the shield shell may be folded in a longitudinal direction of the shielded electric wires with respect to a front edge of the housing to close the housing, and the cover is rotatably supported on a side end of the housing in a width direction of the flat cable or in width direction of the juxtaposed array of separate shielded electric wires.

The connector may further comprise a temporary holding mechanism for temporarily holding the cover in a closing position.

The shield shell is constructed so that the base and lid are formed integrally and the lid is openable with respect to the base. Thus, it is possible to handle the shield shell as a single part and to readily package and manage it during transport. When attaching the shield shell to the housing, the lid merely closes the base without specially positioning the lid with respect to the base, thereby improving a working efficiency.

The base and lid of the shield shell are formed from a sheet of plate. Thus, it is possible to produce the entire shield shell by a single mold and to reduce a producing cost.

Opposite ends of the fold line have notches that guide a folding force. The beads are formed on the coupling pieces at either upper or lower portions with respect to the fold line to enhance strength of the coupling piece. Thus, the coupling pieces can be folded precisely along the fold line.

The coupling pieces can keep a predetermined folding angle, even if a spring-back is caused at an excessive folding angle by using the escape recess.

The cover is attached together to the housing. Therefore, it is possible to handle them as a single part and to readily package and manage them during transport. During assembling the cover merely closes the housing without specially positioning the cover with respect to the housing, thereby improving a working efficiency.

The lid of the shield shell is formed integrally and openably to the base, and it is possible to reduce the number of parts. Also, the lid of the shield shell is folded onto the base thereof from a front edge of the housing while the cover is rotatably supported on a side end of the housing. Hence, the lid and cover can be opened independently from each other without interference.

The connector becomes compact and convenient in the case where the cover is in the closing position during transport. Since the cover is temporarily held when it is in the closing position, it is possible to prevent the cover from clattering.

BRIEF DESCRIPTION OF THE DRAWINGS

The foregoing and other features of the present invention will become apparent to one skilled in the art to which the present invention relates upon consideration of the invention with reference to the accompanying drawings.

DETAILED DESCRIPTION OF THE PREFERRED EMBODIMENTS

A first embodiment of a connector for a flat cable in accordance with the present invention will be described below by referring to FIGS. 1 through 11.

Figure 1:
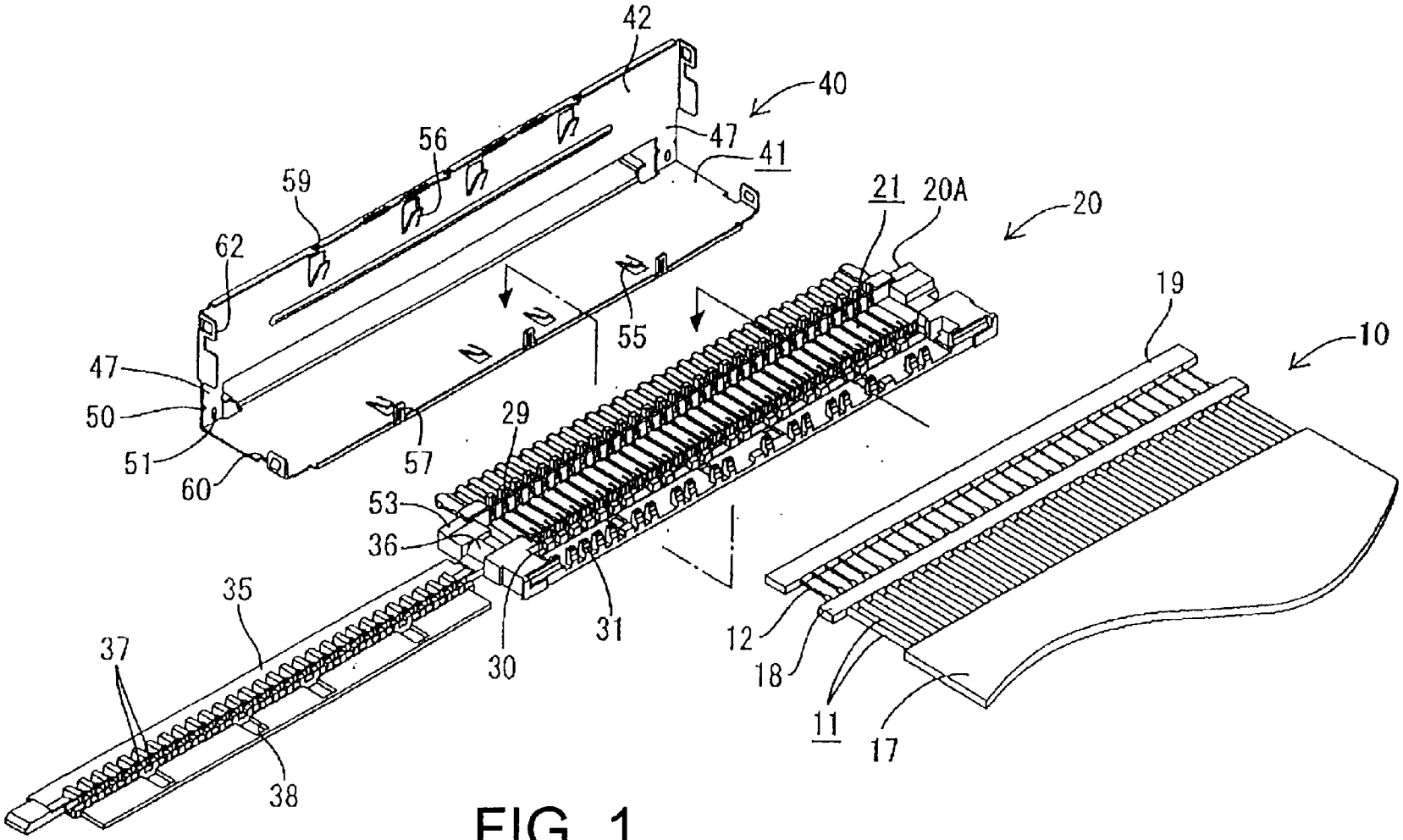
FIG. 1 is an exploded perspective view of a connector of a first embodiment in accordance with the present invention.

A connector in this embodiment, as shown in FIG. 1, generally includes a housing 20 to be attached to a distal end of a flat cable 10 and a shield shell 40 to be mounted on the housing 20.

Figure 6:
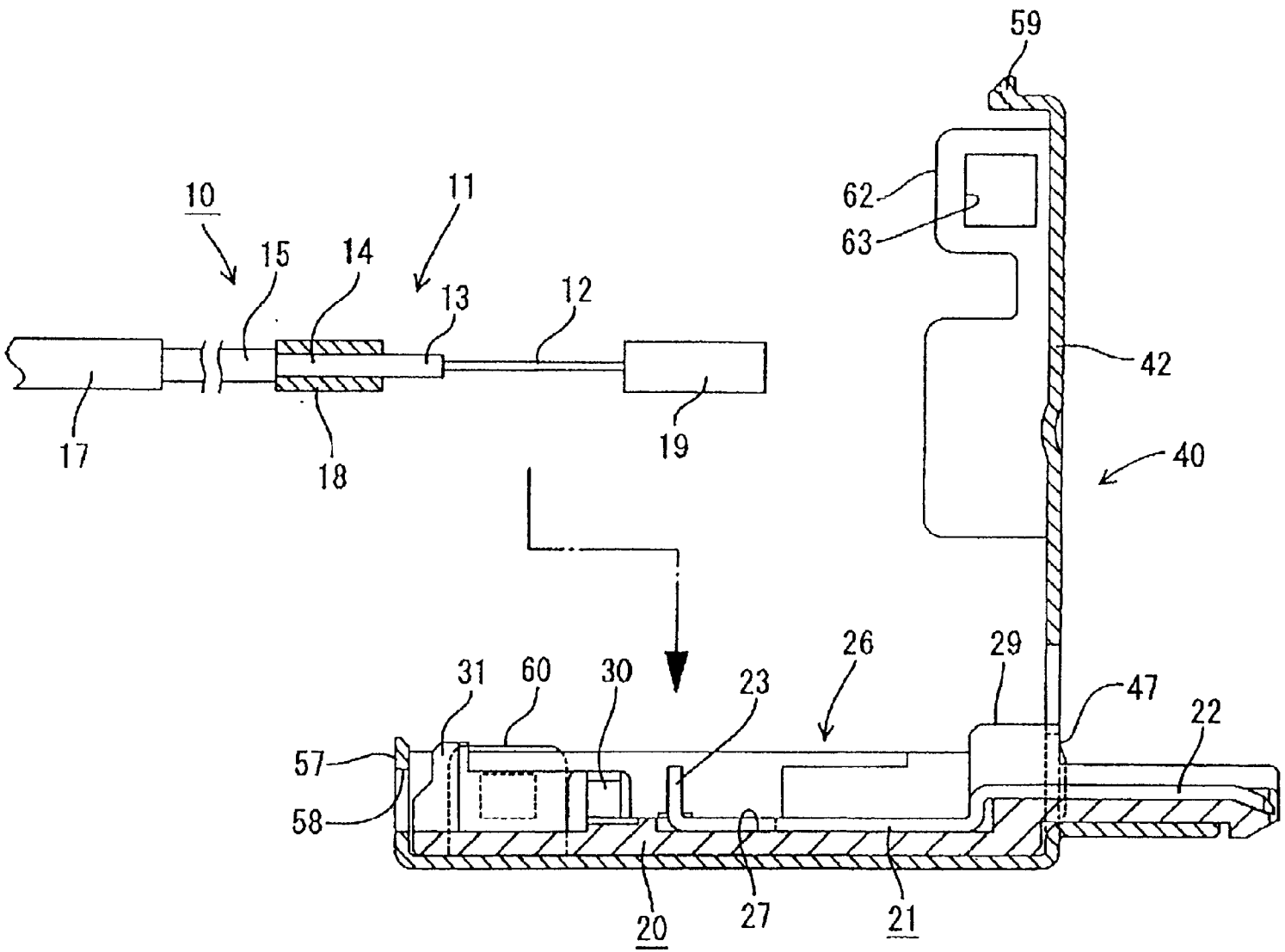
FIG. 6 is a cross sectional view of a connector, illustrating an operation of mounting a distal end of a flat cable onto the connector.

The flat cable 10, as shown in FIG. 6, includes a plurality of parallel shielded electric wires 11 that are spaced from each other at a predetermined distance. Each shielded electric wire 11 has a core 12, an inner coating 13 around the core 12, a shielding layer 14 around the inner coating 13 and an outer coating 15 around the shielding layer 14. A film 17 covers the wires 11 to form a belt-like configuration. A short circuit member 18 is secured to the shielding layer 14 on each shielded electric wire 11 at the distal end of the flat cable 10. The core 12 of each shielded electric wire 11 is exposed at the front side of the short circuit member 18. An aligning sheet 19 is attached to the cores 12 to maintain the cores 12 in positions juxtaposed and spaced away from each other at a predetermined distance.

Figure 2:
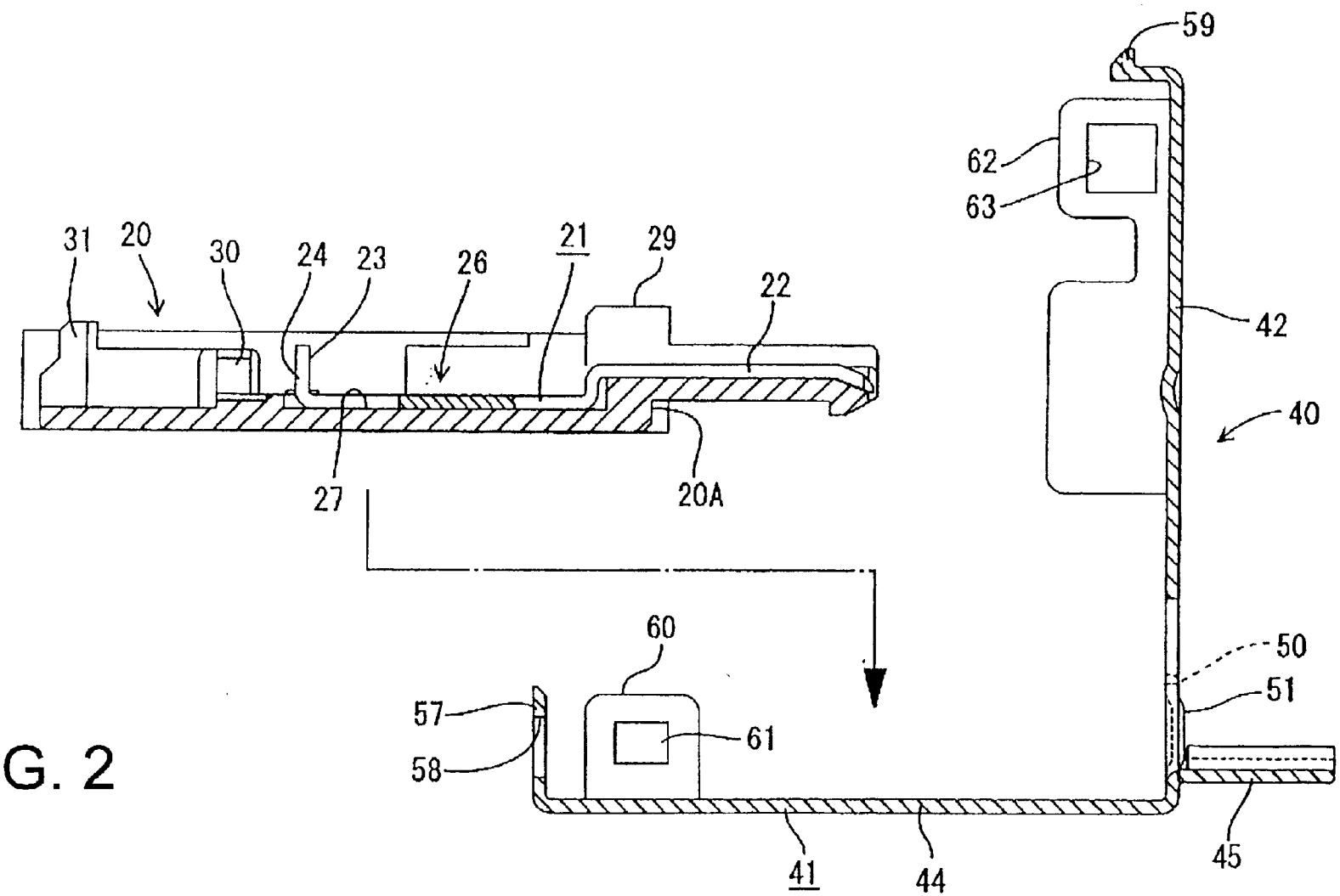
FIG. 2 is a cross sectional view of a housing and a shield shell, illustrating an initial operation of assembling them.

Elongate terminals 21, that are equal in number to the number of the shielded electric wires 11, are mounted on the housing 20, as shown in FIG. 2. Each terminal 21 has a front end with a raised contact portion 22 and a rear end with a Y-bend insulation displacement portion 23 bent upwardly at a right angle. A vertical slot in the insulation displacement portion 23 defines an insulation displacement slot 24 that applies an insulation displacement action to the core 12 of the shielded electric wire 11.

The housing 20 is made of a synthetic resin and is formed into a wide thick plate. An area 26 for receiving the terminals 21 in the housing 20 is defined on two-thirds or more of the front side (right side in FIG. 2) of the housing 20. A front portion of the mounting area 26 is raised and laterally spaced terminal-receiving grooves 27 are formed in the mounting area 26. Partition walls 29 extend from portions near the raised portions to partition a space between the terminal-receiving grooves 27. Accordingly, each terminal 21, as shown in FIG. 2, is fitted into each terminal-receiving groove 27 with the raised contact portion 22 being mounted on the raised portion.

Guides 30 are provided on the portion of the housing 20 immediately rearward from the terminal-mounting area 26. The guides 30 divide a space between the inner coatings 13 of the shielded electric wires 11 in the flat cable 10. Guides 31 are on the rear side edge of the housing 20 and divide a space between the outer coatings 15 of the shielded electric wires 11.

A cover 35 encloses a top surface of the housing 20, extending substantially from the front side partition walls 29 to the guides 31 on the rear side edge. The cover 35 is made of a synthetic resin and is formed separately from the housing 20. The cover 35 is coupled rotatably to the housing 20 by a hinge 36 at a longitudinal end of the cover 35.

Figure 8:
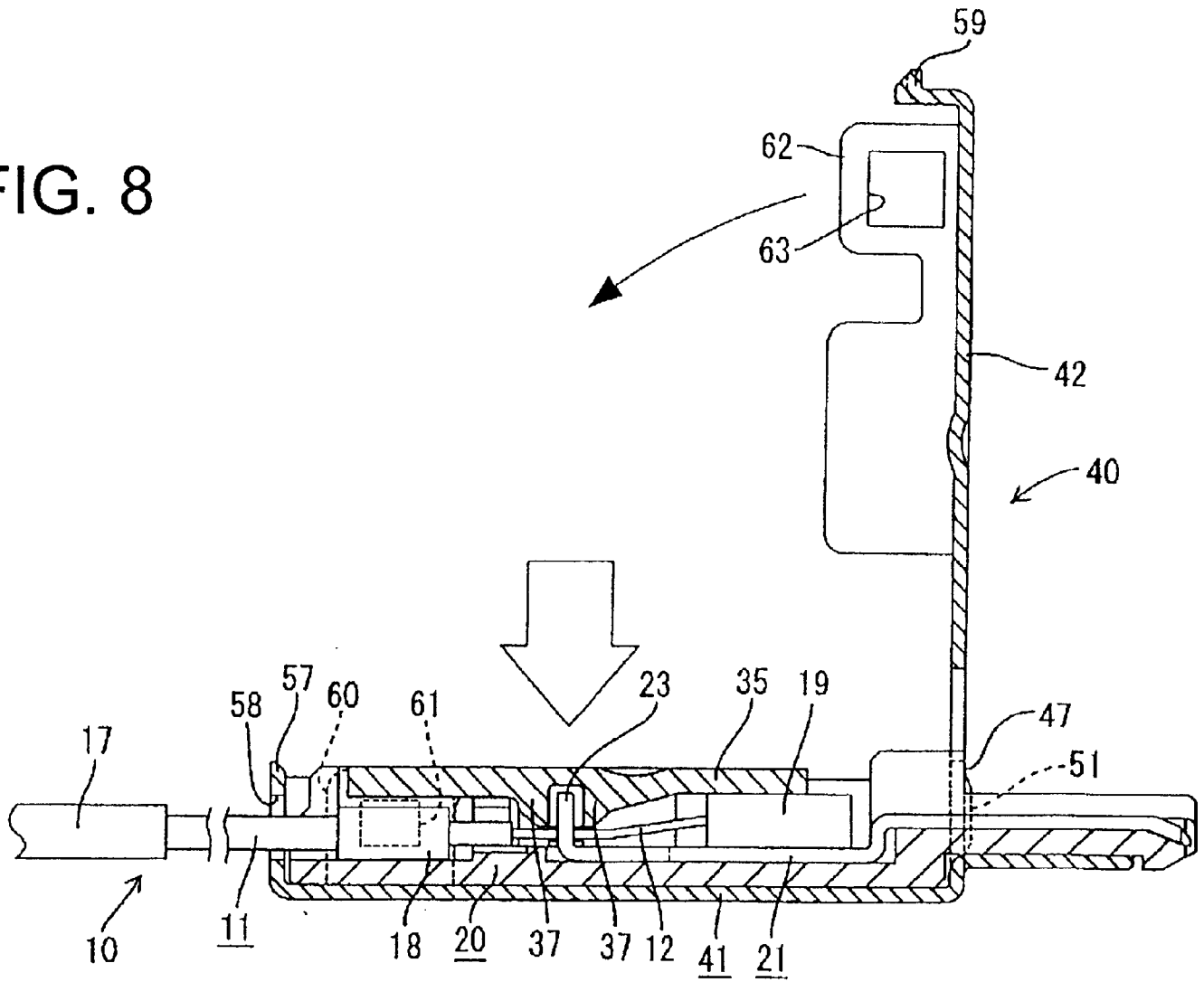
FIG. 8 is a cross sectional view of the connector, illustrating an operation of closing a lid side shell onto a base side shell.

As shown in FIG. 8, the cover 35 has a rear surface with pairs of pressing portions 37 at positions corresponding to the terminal-receiving groove 27 so that the pressing portions 37 are disposed the opposite sides of the insulation displacement portions 23 when the cover 35 is put on the housing 20.

Figure 3:
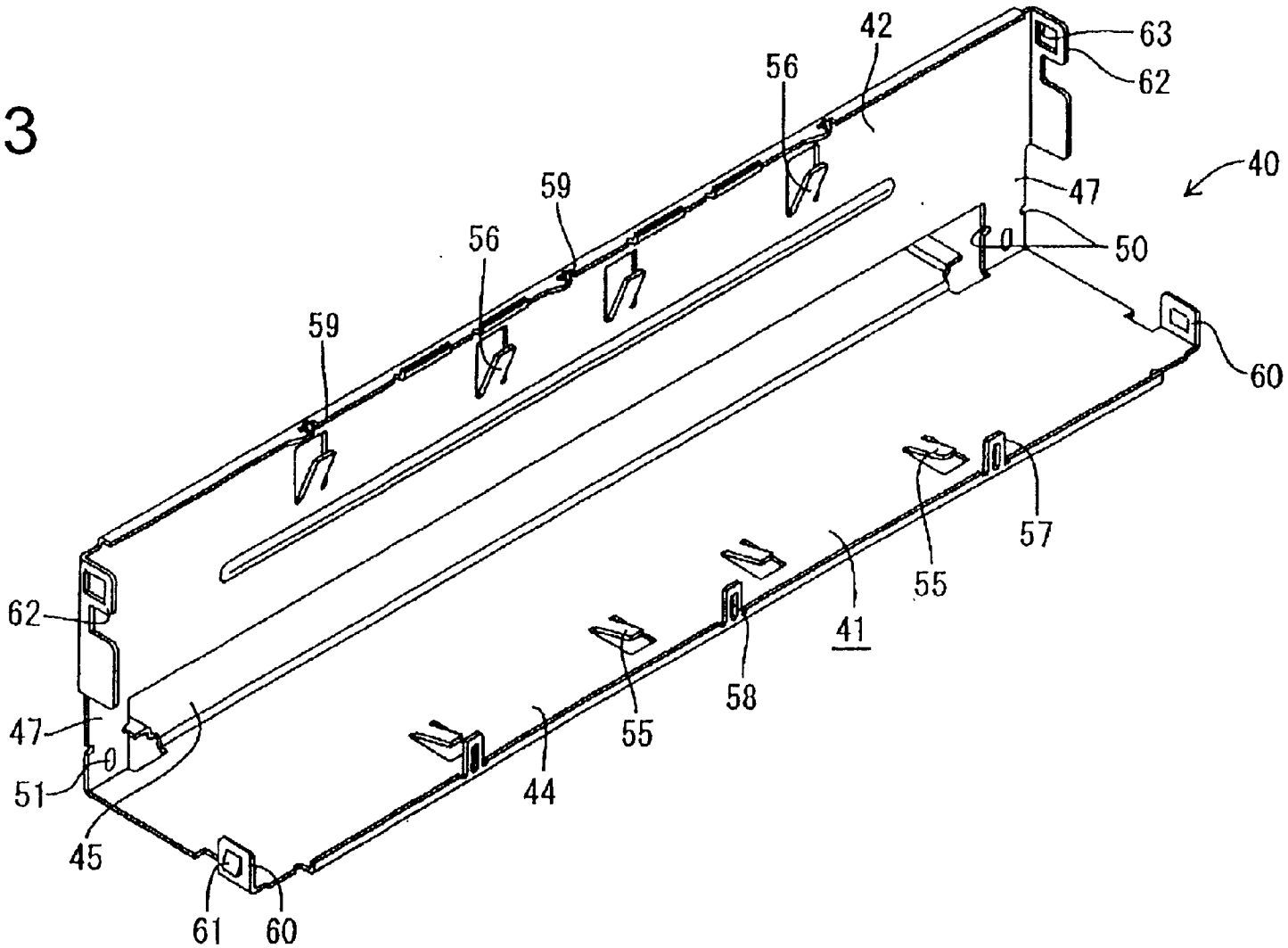
FIG. 3 is a perspective view of a shield shell when it is formed.

The shield shell 40 includes a base 41 and a lid 42 formed integrally by pressing a sheet of conductive metal plate made of a phosphor bronze or the like. More specifically, as shown in FIGS. 2 and 3, the base 41 is configured to contact substantially the entire lower surface of the housing 20. The base 41 of the shield shell 40 includes a flat plate-like body 44 and a raised portion 45 on the front end (right end in FIG. 3) of the flat plate-like body 44 except for the longitudinal opposite ends of the shield shell 40.

Two coupling pieces 47 of given widths extend vertically on the opposite front ends of the body 44 of the base 41. The lid 42 of the shield shell 40 is formed integrally on top portions of the coupling pieces 47. Accordingly, the base 41 of the shield shell 40 initially intersects the lid 42 thereof at a right angle.

Figure 4:
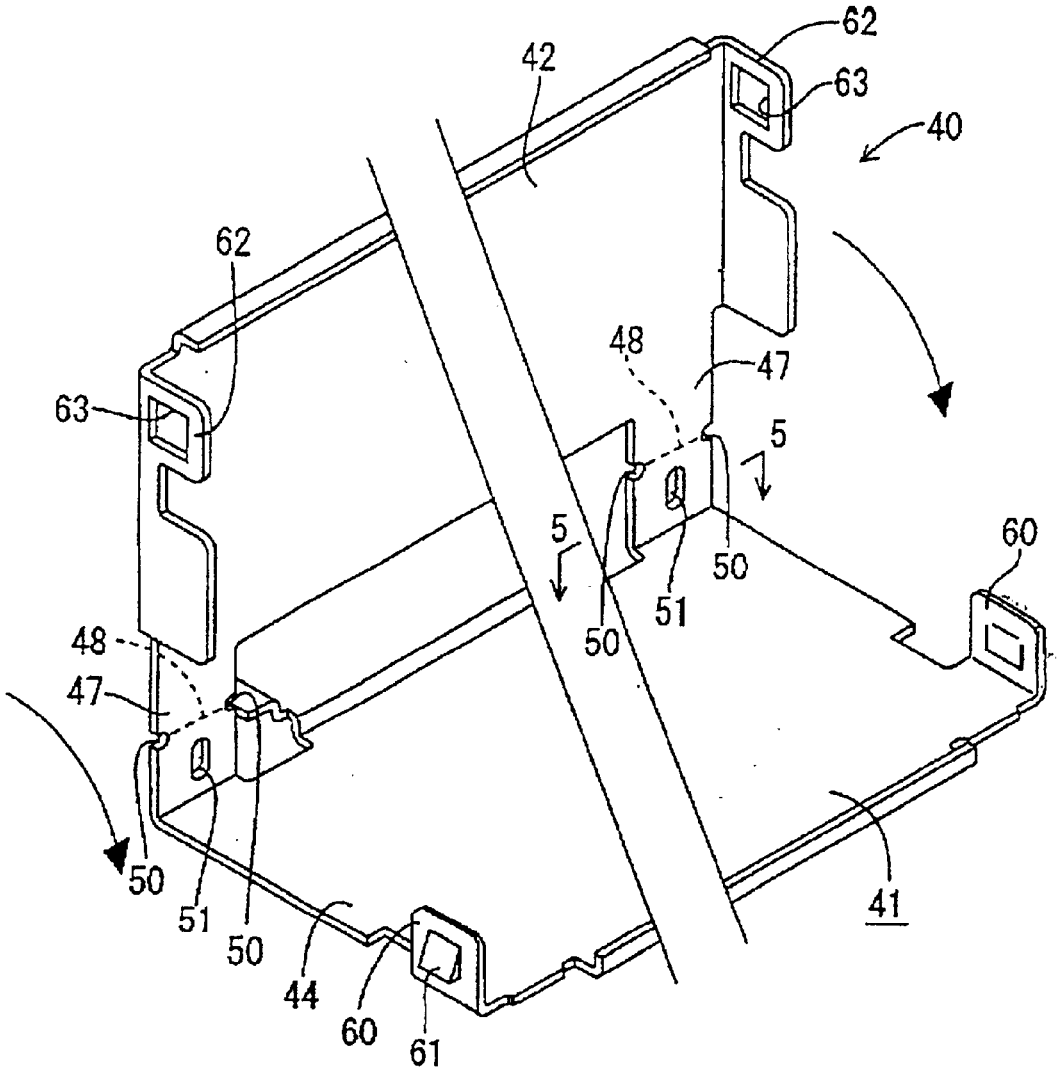
FIG. 4 is a partial perspective view of the shield shell, illustrating a folding operation.
Figure 5:
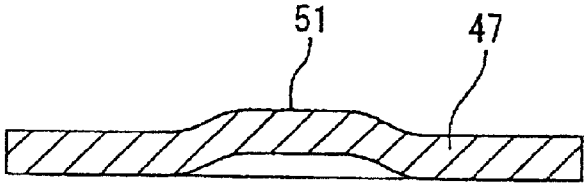
FIG. 5 is an enlarged sectional view of a portion taken along line 5—5 in FIG. 4.

The coupling piece 47 is designed to contact corresponding recessed ends 20A on the front surface of the housing 20. The coupling piece 47 is bent rearward at a right angle about a fold line 48, as shown in FIG. 4. The fold line 48 is at a position corresponding to an upper edge of the contact surface 20A Thus, the lid 42 of the shield shell 40 is folded into parallel alignment with the base 41 of the shield shell 40 to cover the top surface of the housing 20.

The coupling piece 47 is provided with notches 50 on the opposite ends of the fold line 48. As shown in FIG. 2, a bead 51 is formed on the coupling piece 47 below the fold line 48 by pressing the coupling piece 47.

Figure 9:
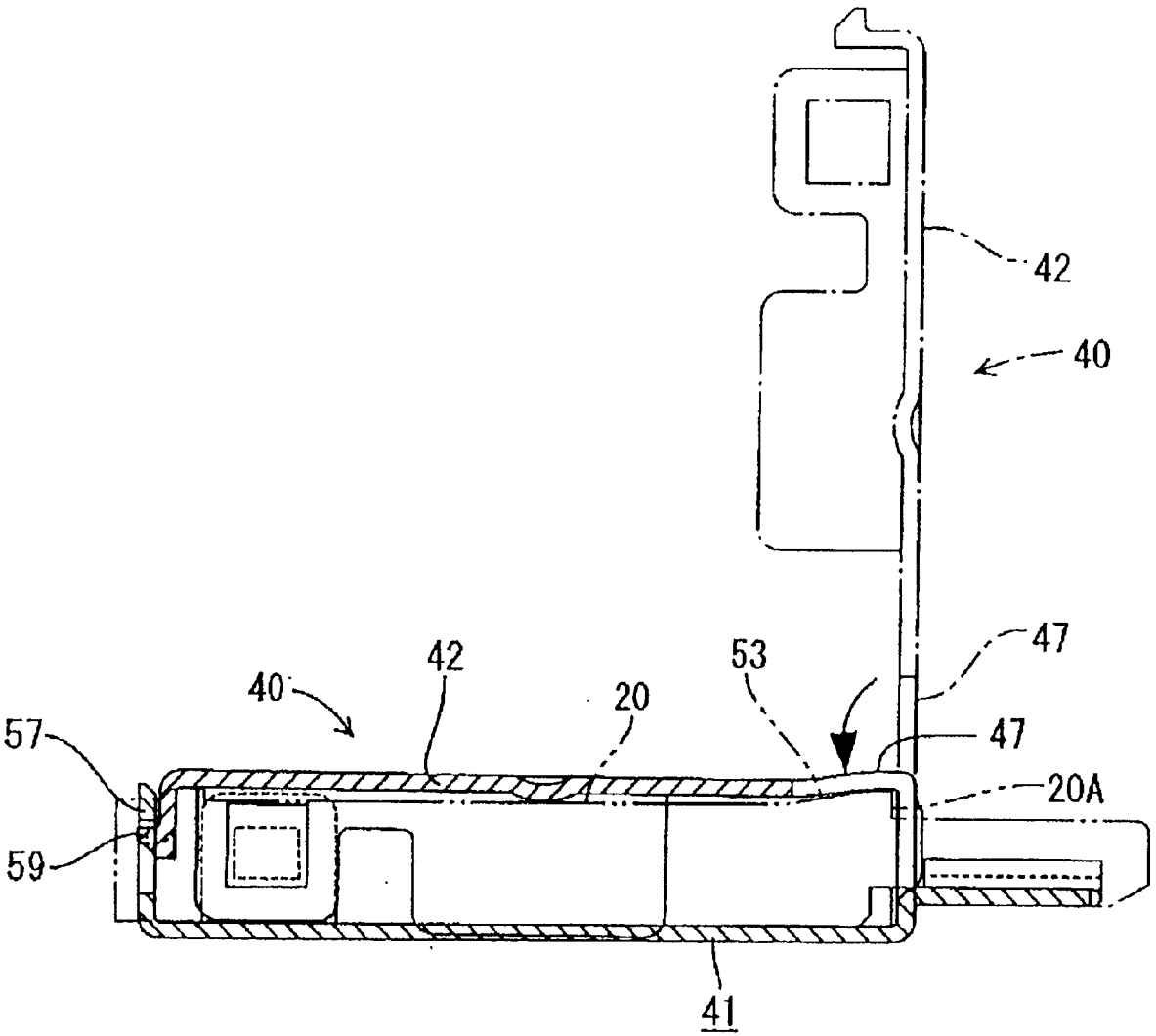
FIG. 9 is an explanatory view illustrating a folding operation of coupling pieces.
Figure 10:
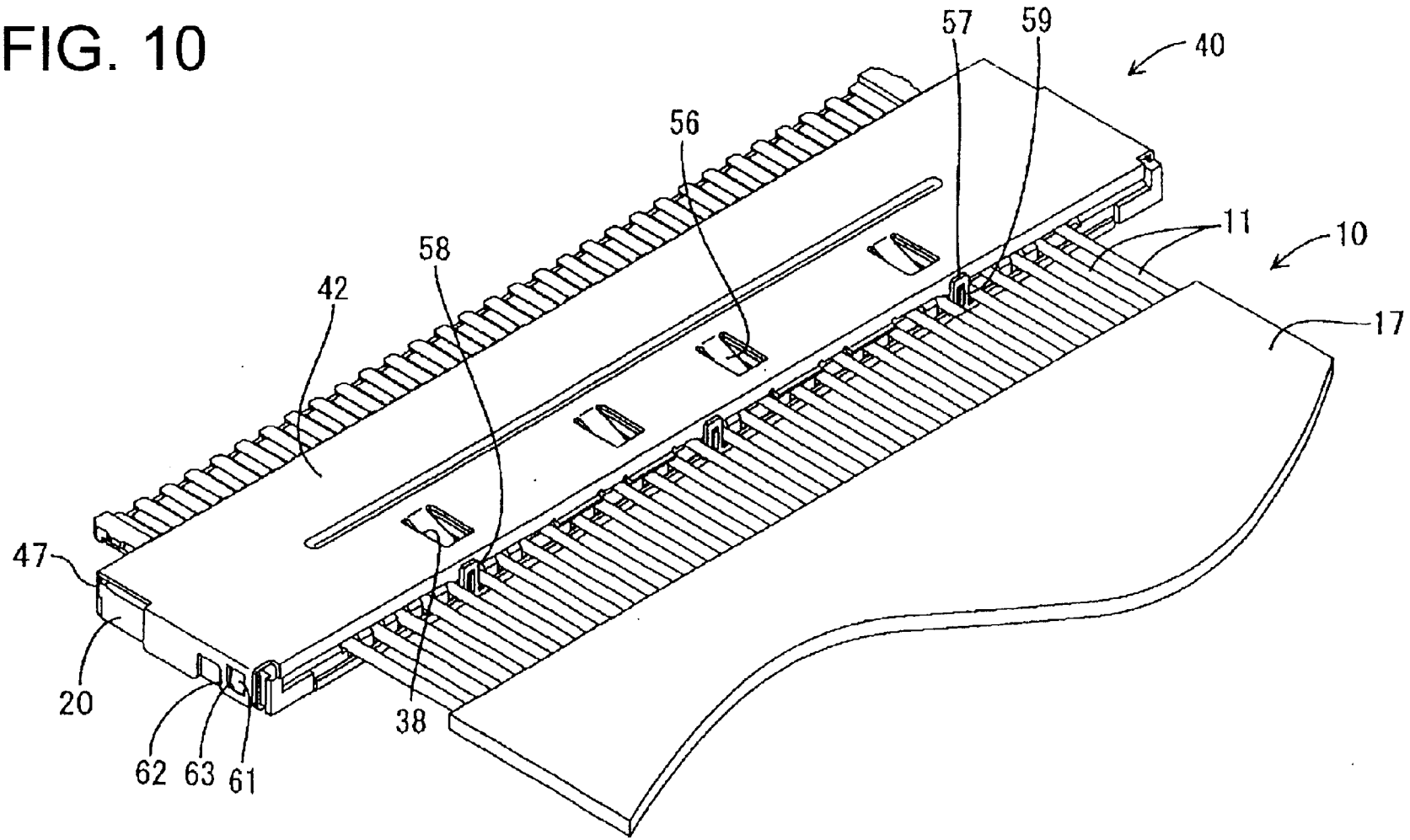
FIG. 10 is a perspective view of the shield shell when the lid side shell finishes a closing operation.
Figure 11:
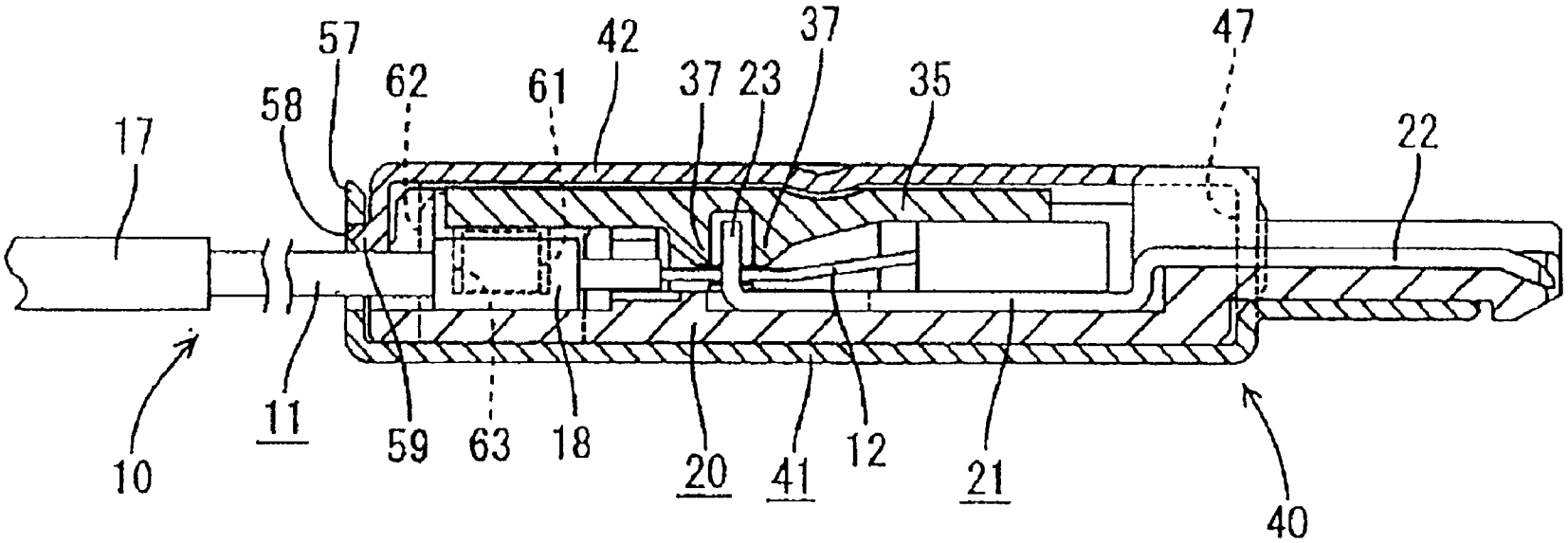
FIG. 11 is a cross sectional view of the connector shown in FIG. 10.

When the coupling pieces 47 are bent, portions above the fold lines 48 are superimposed on the contact surface 20A. This surface of the housing 20, as shown by two-dot chain lines in FIG. 9, is a tapered surface 53 having a downward and rearward inclination. The tapered surface 53 permits the coupling pieces 47 to be bent over 90 degrees.

Referring to FIG. 3 again, four pressing pieces 55 are formed by a punching process on the rear edge side (lower side in FIG. 3) of the body 44 of the base 41. The four pressing pieces 55 elastically contact the lower surface of the housing 20. On the other hand, four contact pieces 56 are formed by a punching process on a free end of the lid 42. The four contact pieces 56 contact the surface of the short circuit member 18 on the flat cable 10. Consequently, as shown in FIG. 1, windows 38 are provided in the cover 35 at positions corresponding to the contact pieces 56 so that the contact pieces 56 enter the window 38.

Three first latch plates 57 are formed on a rear edge of the base 41 of the shield shell 40, and each has a latch groove 58. Hooks 59 are formed on the free end of the lid 42 of the shield shell 40 at positions corresponding to the latch grooves 58 so that the hooks 59 can engage the latch grooves 58 when the lid 42 is bent to a position substantially parallel to the base 41.

Two second latch plates 60 are formed on the opposite rear ends of the base 41 of the shield shell 40. A downwardly inclined detent latch 61 is formed by a punching or pressing process on the outer surface of each second latch plate 60. On the other hand, female latch plates 62 are formed on the opposite side edges of the free end of the lid 42 of the shield shell 40 at positions corresponding to the latch pieces 61 so that the latch pieces 61 engage latch apertures 63 in the female latch plate 62 when the lid 42 is bent to a position substantially parallel to the base 41.

Figure 7:
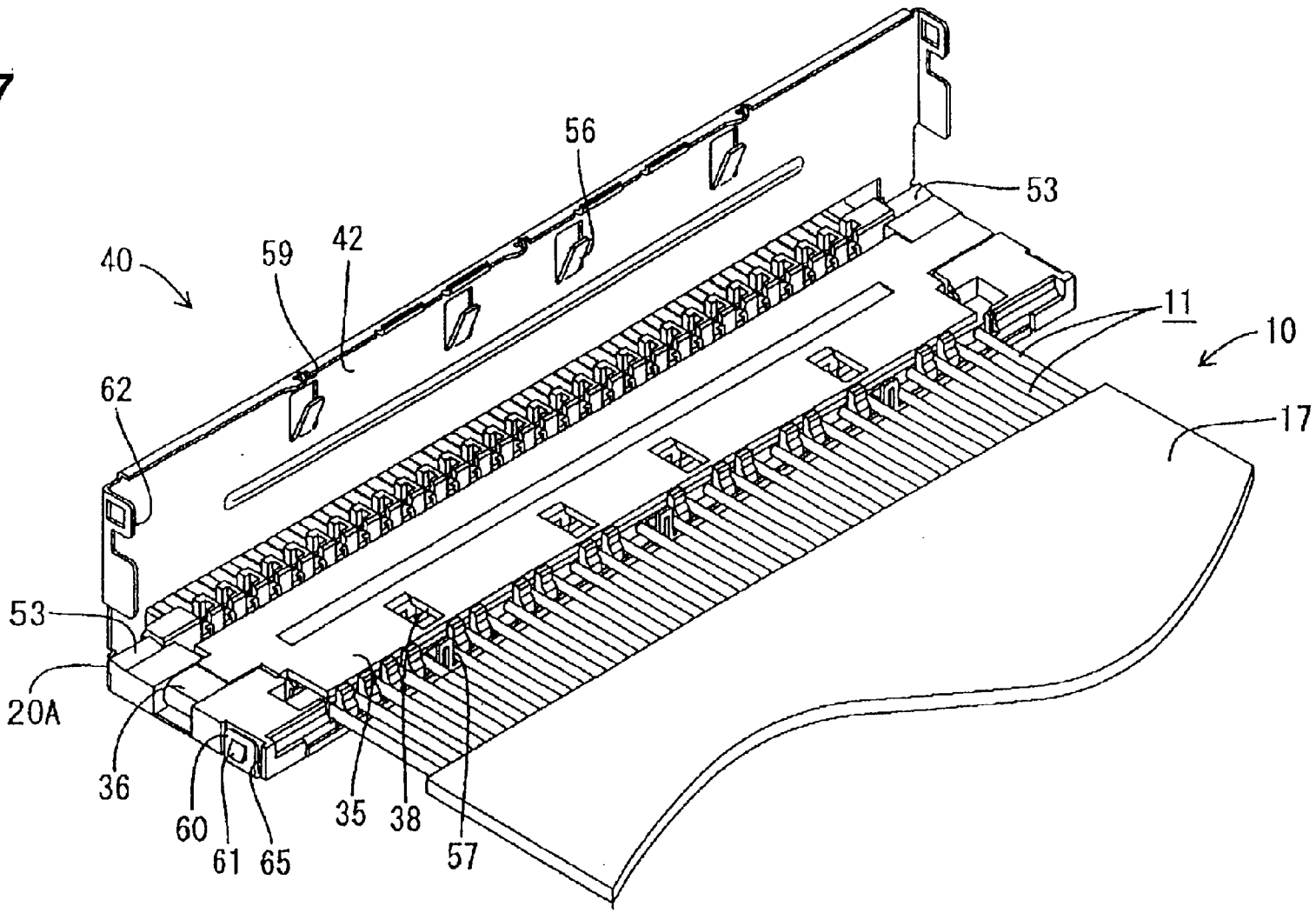
FIG. 7 is a perspective view of the connector, illustrating a cover mounted on the connector.

Mounting recesses 65 are formed on the opposite rear ends of the housing 20, as shown in FIG. 7, so that the second latch plates 60 engage the mounting recesses 65.

Next, a process for assembling the first embodiment of the connector in accordance with the present invention will be described below.

Firstly, the terminals 21 are inserted respectively into the terminal-receiving grooves 27 in the housing 20 while the cover 35 is open. The housing 20 then is mounted onto the base 41 of the shield shell 40, as shown by an arrow in FIG. 2, so that the second latch plates 60 fit into the mounting recesses 65 (FIG. 6). Then, the coupling pieces 47 of the shield shell 40 are brought into contact with the contact surfaces 20A on the opposite front end portions of the housing 20 and the fold line 48 is aligned with the upper edge of the contact surface 20A.

As shown by an arrow in FIG. 6, the distal end of the flat cable 10 is inserted downwardly into the mounting area 26 on the housing 20. The core 12 in each shielded electric wire 11 is pushed into the insulation displacement slot 24 in the insulation displacement portion 23 of the corresponding terminal 21 (FIG. 8). Consequently, each shielded electric wire 11 and each terminal 21 are interconnected.

Next, the cover 35 is turned about the hinge 36 to close the housing 20, as shown in FIG. 7. A pair of pressing portions 37 provided on the rear side of cover 35 are disposed on the opposite sides of the insulation displacement portion 23, thereby pushing the opposite sides of the insulation-displaced portion of the core 12 in each shielded electric wire 11 and maintaining the insulation displacement state.

The lid 42 of the shield shell 40 then is folded rearward about the fold lines 48 on the coupling pieces 47 in the direction shown by the arrow in FIG. 8. The notches 50 on the opposite ends of the fold lines 48 guide the folding action and the beads 51 on the portions of the coupling pieces 47 below the fold lines 48 enhance the strength of the pieces 47. Accordingly, the coupling pieces 47 can be bent precisely along the fold line 48.

The coupling pieces 47 are bent over 90 degrees, as shown in FIG. 9, to lie against the tapered surfaces 53 of the housing 20. Consequently, the coupling pieces 47 can be maintained at the right angle position even if spring-back is caused and the lid 42 of the shield shell 40 can be maintained substantially parallel to the base 41.

As described above, when the lid 42 of the shield shell 40 is folded, hooks 59 on the free end of the lid 42 are fit elastically in the latch grooves 58 in the corresponding first latch plates 57 on the base 41 and latch pieces 61 on the corresponding second latch plates 60 are fit elastically in the latch apertures 63 in the female latch plates 62. Consequently, the housing 20 is disposed and locked between the lid 42 and the base 41 of the shield shell 40.

Thus, the lid 42 of the shield shell 40 pushes the cover 35, and the cores 12 in the shielded electric wires 11 are kept in the insulation displacement state. Simultaneously, the contact pieces 56 on the lid 42 are pressed elastically onto the upper surface of the short circuit member 18 through the windows 38 in the cover 35 to make an electrical connection. The shield shell 40 enclosing the housing 20 can accomplish the shielding effects such as elimination of radiation noises.

According to the first embodiment described above, it is possible to produce the base 41 and lid 42 of the shield shell 40 from a single metal plate and consequently a single mold, to reduce a production cost, to handle the shield shell 40 as a single part, and to readily package and manage the parts during transportation. When assembling the parts, the lid 42 of the shield shell 40 can close onto the base 41 thereof by merely folding the coupling pieces 47. There is no particular step for positioning the lid 42 with the base 41. This results in superior efficiency in working.

The notches 50 on the opposite ends of the fold lines 48 guide the folding action and the beads 51 on the portions of the coupling pieces 47 below the fold lines 48 enhance the strength of the coupling pieces 47. Accordingly, the coupling pieces 47 can be bent precisely along the fold lines 48.

The coupling pieces 47 can be bent over 90 degrees by using the tapered surfaces 53 of the housing 20. Consequently, the coupling pieces 47 can be maintained at the right angle position even if spring-back is caused and thus the lid 42 of the shield shell 40 can be maintained substantially parallel to the base 41 of the shield shell 40. Accordingly, it is possible to prevent the latches on the shells 41 and 42 from receiving an excessive load.

A second embodiment of a connector for a flat cable in accordance with the present invention will be described below by referring to FIGS. 12 through 16. The second embodiment is substantially the same as the first embodiment except for a connecting and locking mechanism for the cover 35 and housing 20. Accordingly, for a convenience of explanation, the construction substantially similar to that of the first embodiment is omitted in the description as to the second embodiment.

Figure 15:
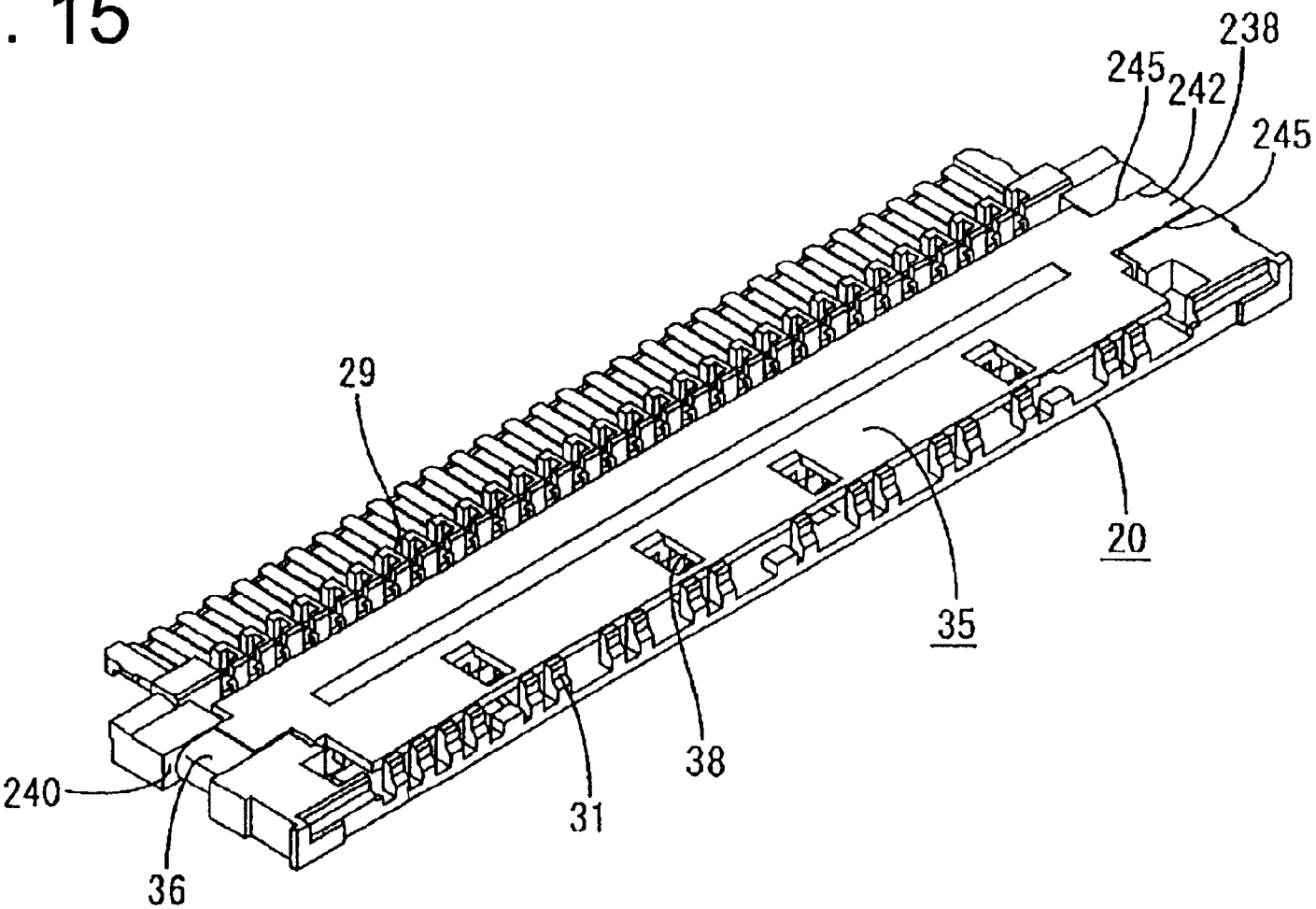
FIG. 15 is a perspective view of the housing and cover, illustrating the cover in a temporary closing position on the housing.

A cover 35, as shown in FIG. 15, is provided on the housing 20 so that the cover 35 encloses a top surface area of the housing 20 extending substantially from the front side partition walls 29 to the guides 31 at the rear side edge of the housing 20. The cover 35 is made of a synthetic resin and is formed separately from the housing 20.

Figure 12:
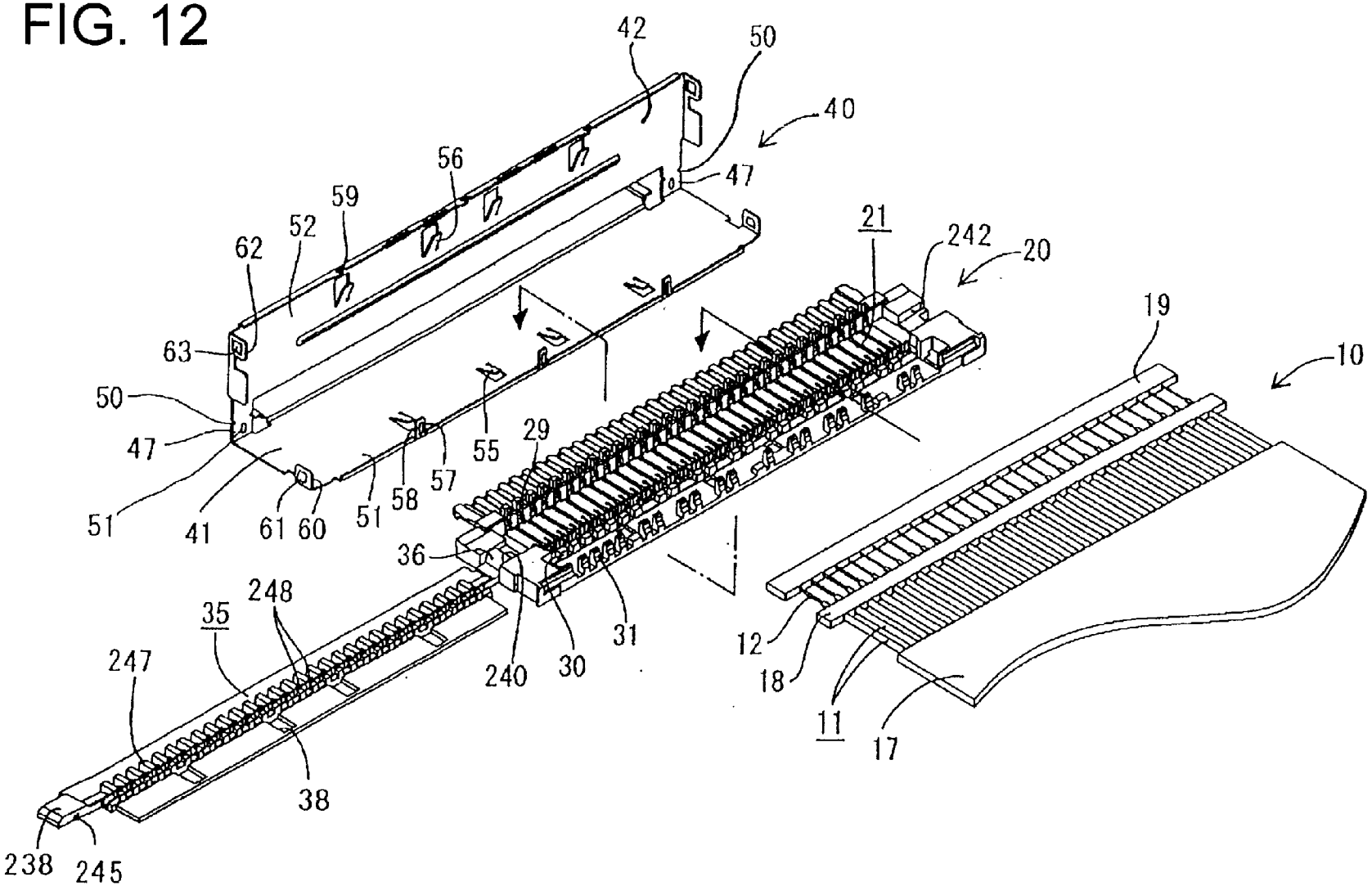
FIG. 12 is an exploded perspective view of a connector of a second embodiment in accordance with the present invention.
Figure 13:
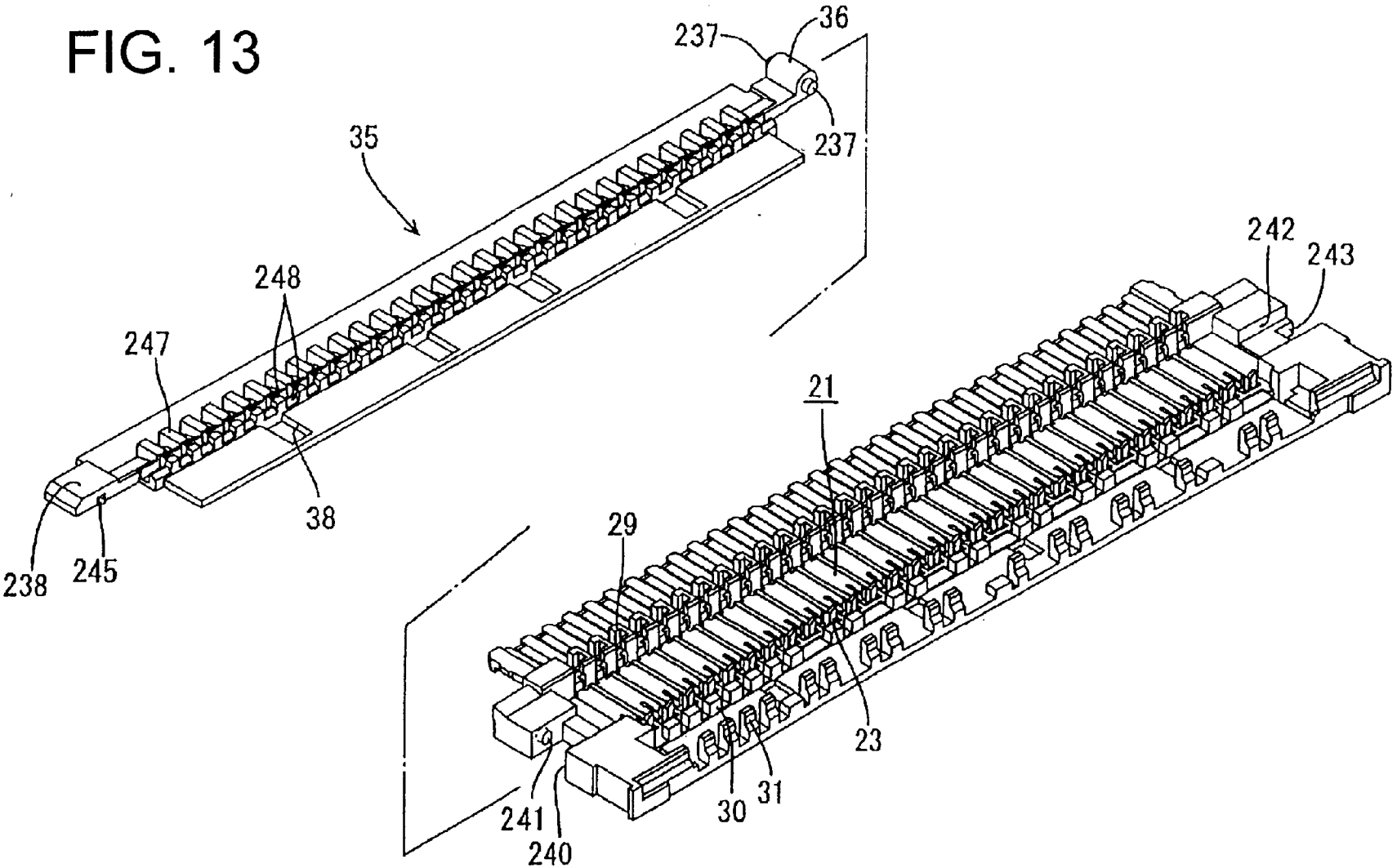
FIG. 13 is an exploded perspective view of a housing and a cover.
Figure 14:
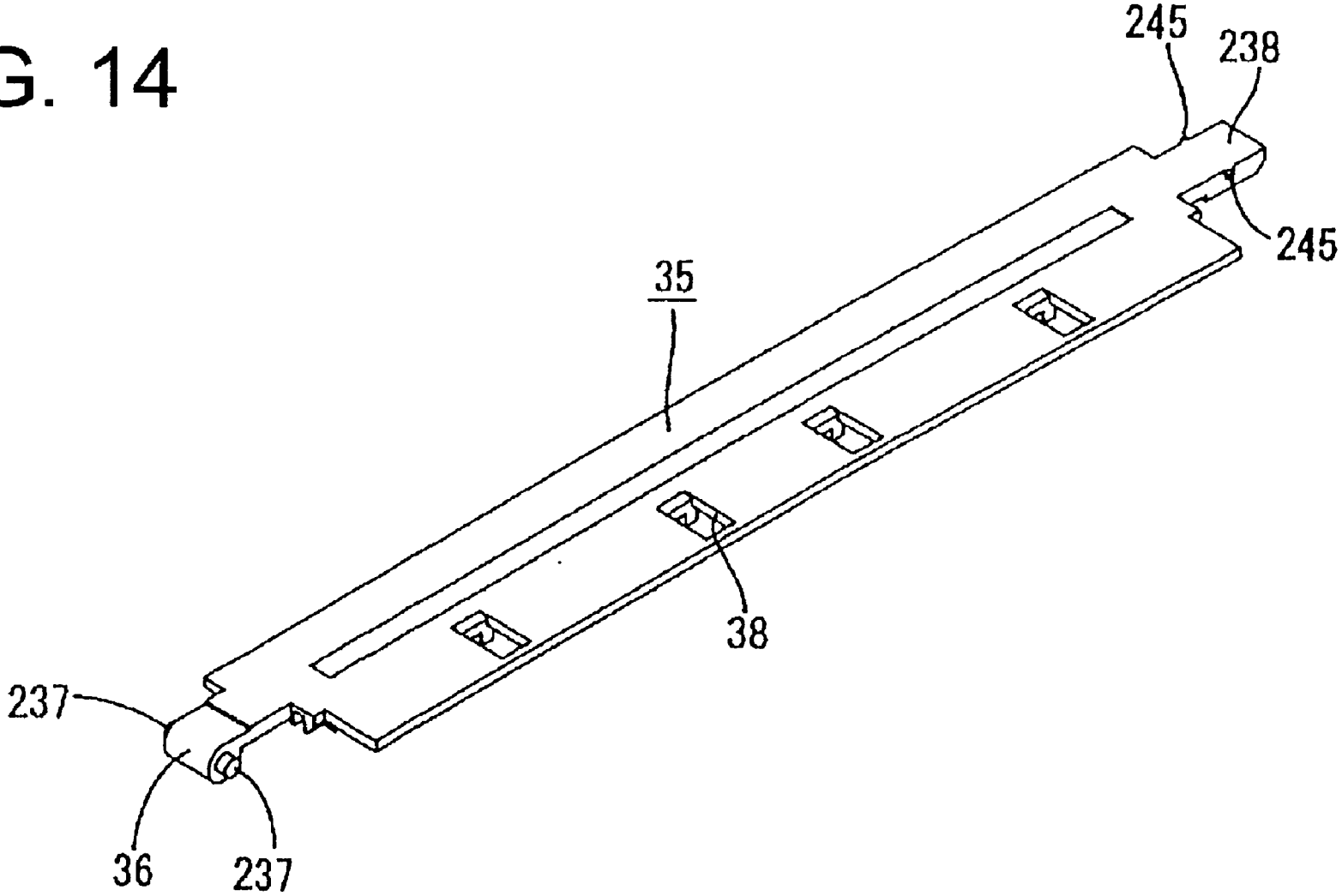
FIG. 14 is a perspective view of the cover.

The cover 35 is provided on an end in its width direction with a hinge or an axle portion 36, as shown in FIGS. 12 and 13. The axle portion 36 has a pin 237 on each of the opposite ends thereof. The cover 35 is provided on the other end with an operating portion 238.

The housing 20 is provided on an end in its width direction (left and lower part in FIG. 12) with a mounting groove 240 in which the axle portion 36 is fitted. Bearing holes 241 are formed in the opposite walls that define the mounting groove 240, respectively. The cover 35 is rotatably supported on the end of the housing 20 about the pins 237 by fitting the pins 237 of the axle portion 36 into the bearing holes 41.

The housing 20 is provided on the other end in its width direction with a containing groove 242 having a bottom wall in which the operating portion 238 is fitted tightly when the cover 35 is brought into a regular closing position. The operating portion 238 is provided on the opposite ends with press-fitting projections 245 that are press-fitted in the containing groove 242. A jig inlet port 243 is formed in the outer end of the bottom wall of the groove 242 so that a jig G (see FIG. 15) can be inserted upwardly.

As shown in FIG. 12, the cover 35 is provided on the rear side with partitions 247 that enter spaces between adjacent insulation displacement portions 23 on the terminals 21 mounted in the housing 20 when the cover 35 is put on the housing 20, as shown in FIG. 8. Plural pairs of pushing portions 248 are formed between adjacent partitions 247. The pushing portions 248 enter spaces between adjacent insulation displacement portions 23 and push the cores 12 of the shielded electric wires 11 when the cover 35 is driven into the closing position.

The shield shell 40 includes a base 41 and a lid 42 formed integrally by pressing a sheet of conductive metal plate made of a phosphor bronze or the like. The base 41 of the shield shell 40 has a configuration that can contact substantially the entire lower surface of the housing 20. Two coupling pieces 47 extend vertically on each of the opposite front ends of the base 41 of the shield shell 40. The lid 42 of the shield shell 40 is formed integrally on the top portions of the coupling pieces 47. Accordingly, the base 41 of the shield shell 40 intersects the lid 42 thereof at a right angle. The coupling pieces can be folded at each of the intermediate positions.

Next, a process for assembling the second embodiment of the connector in accordance with the present invention will be described below.

First, the terminals 21 are inserted into the respective terminal-receiving grooves 27 in the housing 20. The cover 35 is supported rotatably on an end of the housing 20 by inserting the pins 237 of the axle portion 36 into the bearing holes 241 in the housing 20. Upon transportation, the cover 35 closes the housing 20, as shown in FIG. 15, and is held in a temporary closed position by press-fitting the projections 245 on the operating portion 238 into the opposed walls of the containing groove 242.

Figure 16:
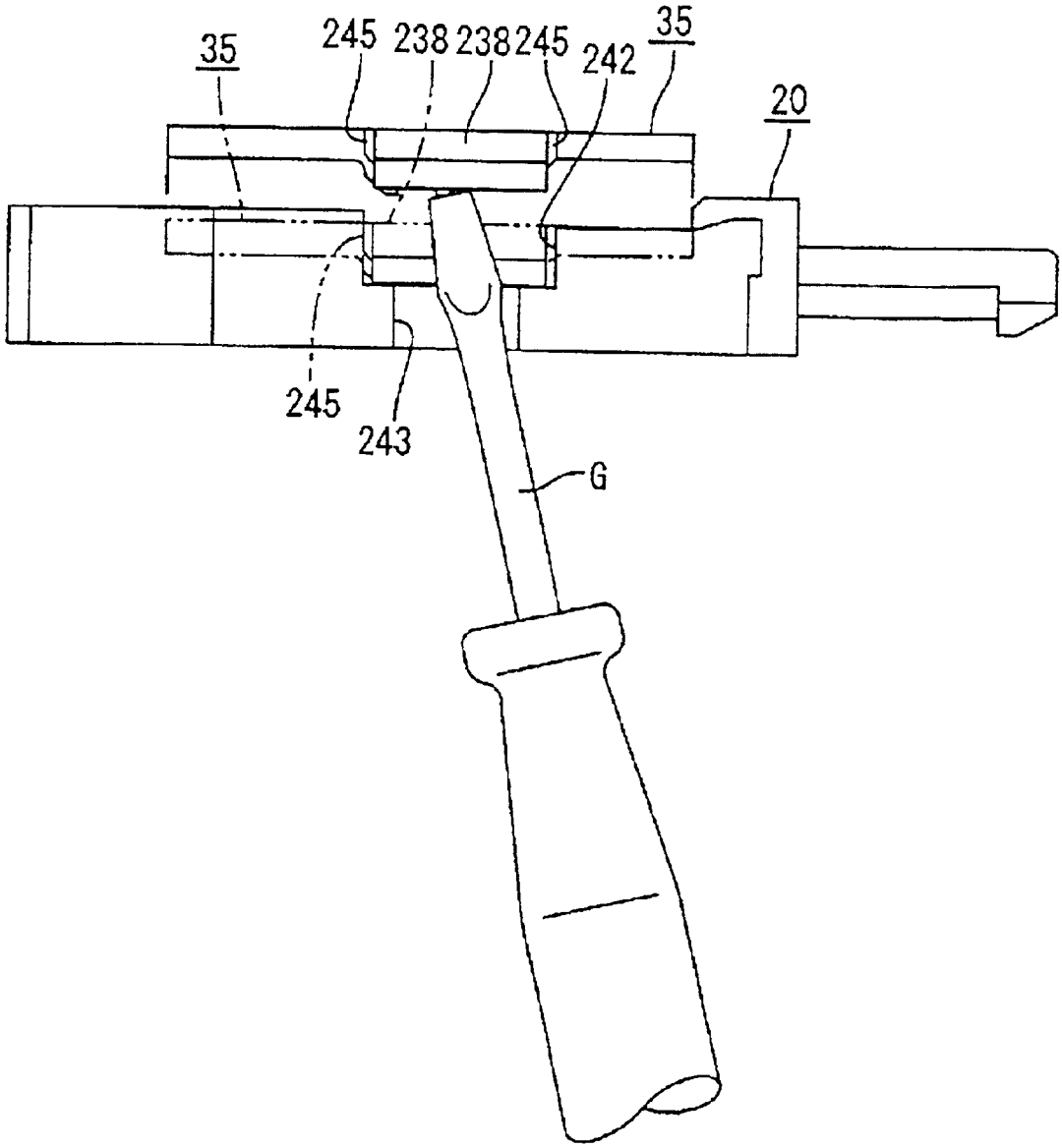
FIG. 16 is a side elevation view of the housing and cover, illustrating an operation for releasing the temporary closing position of the cover.

The cover 35 is driven into an open position to enable assembly of the connector. At this time, the operating portion 238 is lifted out of the containing groove 242 by inserting the jig G into the jig inlet port 243 formed in the bottom wall of the containing groove 242 in the housing 20, as shown in FIG. 16. The cover 35 is driven from the closing position shown in FIG. 15 into the opening position shown in FIG. 12 by manually turning the operating portion in the counter-clockwise direction in FIG. 15.

After the cover 35 moves to the open position, as shown by the arrow in FIG. 2, the housing 20 is mounted onto the base 41 of the shield shell 40.

Next, as shown by the arrow in FIG. 6, the distal end of the flat cable 10 is inserted downwardly into the mounting area 26 on the housing 20. The core 12 in each shielded electric wire 11 is pushed into the insulation displacement slot 24 in the insulation displacement portion 23 of the corresponding terminal 21 (FIG. 8). Consequently, each shielded electric wire 11 and each terminal 21 are interconnected.

The cover 35 is turned back about the axle portion 36 to close the housing 20, as shown in FIG. 7, after the distal end of the flat cable 10 has been mounted. A pair of pressing portions 37 provided on the rear side of the cover 35 are disposed on the opposite sides of the insulation displacement portion 23, as shown in FIG. 8, thereby pushing the opposite sides of the insulation-displaced portion of the core 12 in each shielded electric wire 11 and maintaining the insulation displacement state.

The lid 42 of the shield shell 40 is folded rearward in a direction shown by the arrow in FIG. 8. When bending the lid 42 at 90 degrees with respect to the base 41, hooks 59 on the free end of the lid 42 are fit elastically in the latch grooves 58 in the corresponding first latch plates 57 on the base 41 and latch pieces 61 on the corresponding second latch plates 60 are fit elastically in the latch apertures 63 in the female latch plates 62. Consequently, the housing 20 is disposed and locked between the lid 42 and the base 41 of the shield shell 40.

Thus, the lid 42 of the shield shell pushes the cover 35 and the cores 12 in the shielded electric wires 11 are kept in the insulation displacement state. Simultaneously, the contact pieces 56 on the lid 42 are pressed elastically onto the upper surface of the short circuit member 18 through the windows 38 in the cover 35 to make an electrical connection. The shield shell 40 enclosing the housing 20 can accomplish the shielding effects such as elimination of radiation noises.

According to the second embodiment, the cover 35 is attached to the housing 20, and it is possible to handle them as a single part and to readily package and manage them for transport. When assembling them, the cover 35 merely closes the housing 20 without specially positioning the cover 35 with respect to the housing 20, thereby improving a working efficiency.

The cover 35 that pushes the shielded electric wires 11 to maintain the insulation displacement of the wires 11 is formed from a synthetic resin. Thus, it is possible to prevent the wires from being short-circuited, in comparison with a conventional manner in which the shield shell pushes the shielded electric wires.

The lid 42 is formed integrally and openably to the base 41 of the shield shell 40. Thus, it is possible to reduce the number of parts. Also, the lid 42 is folded onto the base 41 from a front edge of the housing 20 in the shield shell 40 while the cover 35 is supported rotatably on a side end of the housing 20. Therefore, the lid 42 of the shield shell 40 and cover 35 can be opened independently from each other without interference.

The connector becomes compact and convenient in the case where the cover 35 is in the closing position during transportation. Since the cover 35 is temporarily held in the closing position, it is possible to prevent the cover 35 from clattering.

Figure 17:
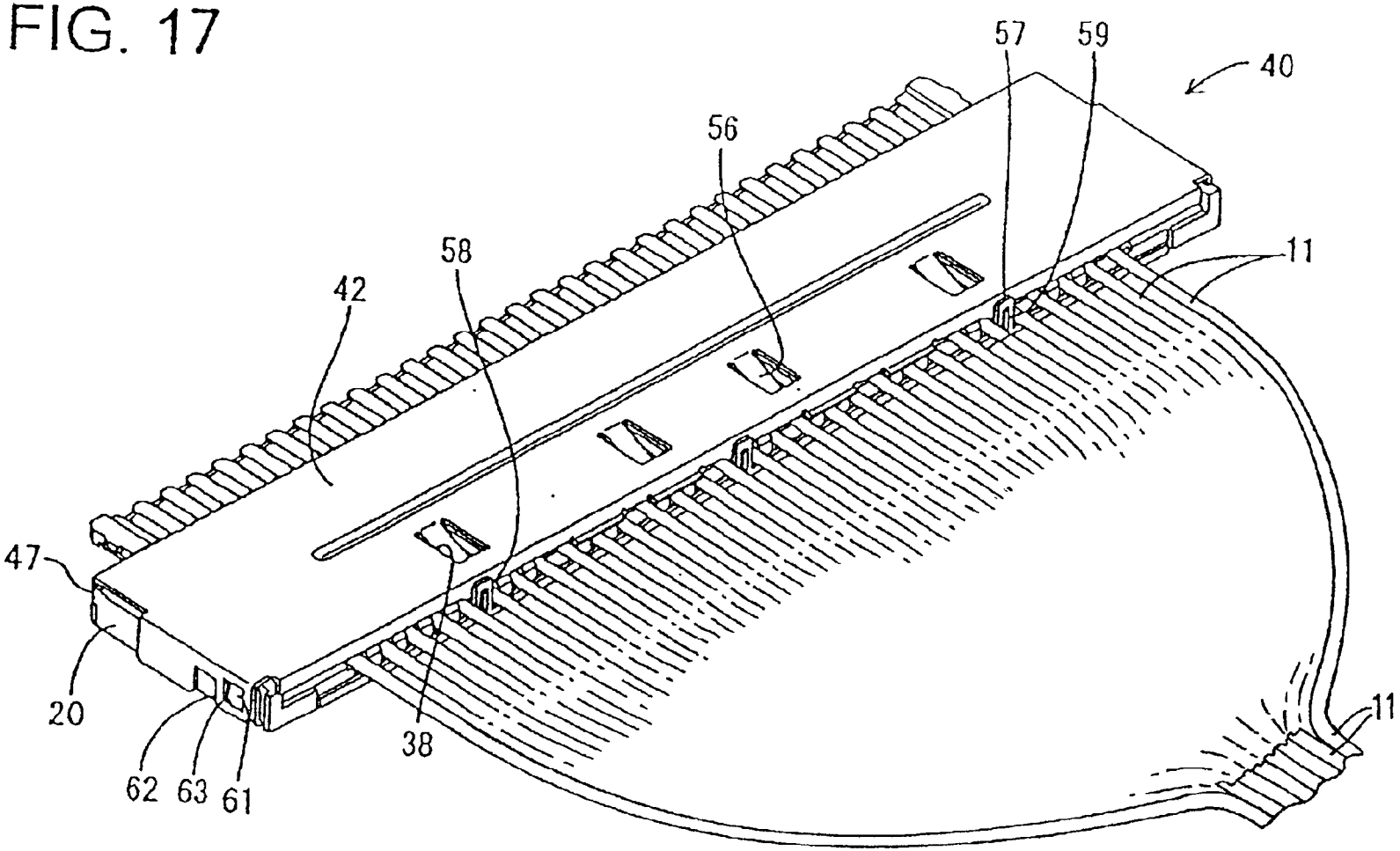
FIG. 17 is s perspective view similar to FIG. 10, but showing the connector employed with a juxtaposed array of separate shielded electric wires.

FIG. 17 shows the shield shell 40 substantially as described and illustrated above and used with a plurality of separate shielded electric wires 11 that are not part of a flat cable. The operation, advantages and effects of the shield shell 40 shown in FIG. 17 is identical to the embodiments described and illustrated in FIGS. 1–16. As a further alternate, one or more sheets of a film, similar to the film 17 described and illustrated above may be disposed over the separate shielded electric wires 11 for a short longitudinal section near the shield shell 40. The film may help to ensure that a substantially planar array of separate shielded electric wires 11 extends into the shield shell 40. However, the separate shielded electric wires 11 may be bundled into a non-planar array at locations disposed on the side of the film opposite the shield shell 40 and spaced a selected distance from the film.

It should be noted that the present invention is not limited to the above embodiments stated in the descriptions and illustrated in the drawings. For example, the following examples should be included in the technical scope of the present invention. The embodiments except for the following embodiments can be carried out by applying various modifications without departing from the gist of the present invention.

A lid for the shield shell may be produced separately from a base and rotatably coupled to the base of the shield shell through a hinge.

In the shield shell, a lid may be produced separately from a base and may be coupled to the base later on.

In the case where a lid of a shield shell is produced separately from a base, a cover may be folded from a front edge of a housing to close the housing.

The entire disclosures of Japanese Patent Application No. 2001-180392 filed on Jun. 14, 2001 and Japanese Patent Application No. 2001-180393 filed on Jun. 14, 2001 including the specification, claims, drawings and summary are incorporated herein by reference in its entirety.

What is claimed is:

1. An electrical connector for a plurality of juxtaposed shielded electric wires, each said shielded electric wire having a core and a shielding layer, the connector comprising:

a housing;

a plurality of terminals in the housing and configured for connection to the cores of the shielded electric wires; and a shield shell covering said housing and configured for connection to the shielding layers of said shielded electric wires, said shield shell comprising a base mounted to said housing and a lid formed integrally with said base so that said lid of said shield shell can be moved to an open position and a closing position with respect to said base of said shield shell, said base and said lid of said shell being formed integrally from a single plate through coupling pieces, each of said coupling pieces being provided with a fold line and two notches disposed on opposite respective ends of the fold line on each coupling pieces, said notches and said fold lines being substantially colinear for enablinig the lid to be folded precisely along the fold lines and relative to the base.

2. An electrical connector for a plurality of juxtaposed shielded electric wires, each said shielded electric wire having a core and a shielding layer, the connector comprising:

a housing with opposite top and bottom surfaces and opposite front and rear surfaces;

a plurality of terminals in the housing and configured for connection to the cores of the shielded electric wires; and a shield shell covering said housing and configured for connection to the shielding layers of said shielded electric wires, said shield shell comprising a base mounted to said bottom surface of said housing and a lid formed integrally with said base so that said lid of said shield shell can be moved to an open position and a closing position with respect to said base of said shield shell, said base and said lid of said shield shell being formed integrally from a single plate through foldable coupling pieces aligned substantially perpendicular to said base and said lid, wherein escape recesses are formed on said top surfaces of said housing at locations that oppose the folded portions of said coupling pieces, portions of the top surface at he escape recesses being aligned to the front surface at an acute angle so that said lid initially can be folded relative to the coupling pieces more than a right angle.

3. The connector of claim 2, wherein said base and said lid of said shell are substantially parallel when said lid is in said closing position, said foldable coupling pieces having a portion extending substantially perpendicularly from said base and a portion folded through an angle of greater than 90° and aligned with one of said escape recesses of said housing.

4. The connector the claim 2, wherein the housing has opposite top and bottom surfaces and opposite front and rear ends extending between the top and bottom surfaces, the foldable coupling pieces of the shield shell being disposed substantially adjacent the front end of the housing, the escape recesses being formed on the top surface of the housing adjacent the front end of the housing and aligned with the respective foldable coupling pieces, each said escape recess being tapered downwardly and rearwardly.

5. An electrical connector for a plurality of juxtaposed shielded electric wires, each said shielded electric wire having a core and a shielding layer, the connector comprising:

a housing;

a plurality of electrically separated terminals in the housing and configured for connection respectively to the cores of the shielded electric wires;

a cover retractably coupled to said housing to maintain a contact condition between said shielded electric wires and said terminals by pushing said shielded electric wires; and a shield shell covering said housing and said cover and configured for connection to the shielding layers of said shielded electric wires, said shield shell comprising a base mounted to said housing and a lid formed integrally with said base so that said lid of said shield shell can be moved to an open position and a closing position with respect to said base of said shield shell wherein said lid of said shield is folded in a longitudinal direction of said shielded electric wires with respect to a front edge of said housing to close said housing, and said cover is supported on a side end of said housing retractably in a width direction of said electric wires.

6. The connector of claim 5, wherein said base and lid of said shield shell are formed integrally through foldable coupling pieces from a sheet of plate.

7. The connector of claim 6, wherein each of said coupling pieces is provided on the opposite ends of a fold line with notches and a bead for reinforcement is formed on each said coupling piece substantially adjacent said fold line.

8. The connector of claim 7, wherein escape recesses are formed on surfaces of said housing that oppose folded portions of said coupling pieces so that said coupling pieces can be folded more than a predetermined foldable angle.

9. The connector of claim 5, wherein said housing has opposite top and bottom surfaces, said base of said shield shell being formed with a plurality of pressing pieces configured for elastically contacting the bottom surface of the housing and urging the housing towards the lid of the shield shell.

* * * * *